US011497667B2

(12) United States Patent
Herfert

(10) Patent No.: US 11,497,667 B2
(45) Date of Patent: Nov. 15, 2022

(54) APPARATUS AND METHOD FOR NETWORKED TRANSPORTATION OF PATIENTS OR PEOPLE WITH IMPAIRED MOBILITY

(71) Applicant: GRENZEBACH MASCHINENBAU GMBH, Asbach-Bäumenheim (DE)

(72) Inventor: Christian Herfert, Langweid (DE)

(73) Assignee: GRENZEBACH MASCHINENBAU GMBH, Asbach-Bäumenheim (DE)

( * ) Notice: Subject to any disclaimer, the term of this patent is extended or adjusted under 35 U.S.C. 154(b) by 775 days.

(21) Appl. No.: 16/461,062

(22) PCT Filed: Nov. 27, 2017

(86) PCT No.: PCT/DE2017/000405
§ 371 (c)(1),
(2) Date: May 15, 2019

(87) PCT Pub. No.: WO2018/103771
PCT Pub. Date: Jun. 14, 2018

(65) Prior Publication Data

US 2019/0307623 A1 Oct. 10, 2019

(30) Foreign Application Priority Data

Dec. 7, 2016 (DE) ..... 10 2016 014 566.8

(51) Int. Cl.
*A61G 7/08* (2006.01)
*A61G 7/05* (2006.01)

(52) U.S. Cl.
CPC ..... *A61G 7/08* (2013.01); *A61G 7/05* (2013.01); *A61G 2203/22* (2013.01); *A61G 2203/80* (2013.01)

(58) Field of Classification Search
CPC ..... A61G 7/08; A61G 7/05; A61G 2203/22; A61G 2203/80; A61G 5/047
See application file for complete search history.

(56) References Cited

U.S. PATENT DOCUMENTS 7,191,854 B2 * 3/2007 Lenkman ..... A61G 7/08 180/19.1
7,419,019 B1 * 9/2008 White ..... A61G 7/08 180/19.1

(Continued)

FOREIGN PATENT DOCUMENTS

DE 202013103255 8/2013
EP 2302541 3/2011

(Continued)

*Primary Examiner* — Richard M Camby
(74) *Attorney, Agent, or Firm* — Duane Morris LLP; Gregory M. Lefkowitz

(57) ABSTRACT

An apparatus a and method for networked transportation of patients or people with impaired mobility in a hospital bed, or nursing bed, having the following method features: a) a patient in question or an applicable caregiver is reported by a control centre as in need of transportation from one ward A to another ward B, b) the nursing staff on ward A beds down or puts the person in question into a special transportation bed or a special transportation chair and reports to the control centre when this person is correctly supported, this being able to be checked by means of a pressure sensor (23) in the lying area or sitting area, the identity being ensured by the nursing staff or being able to be checked by means of a patient identity card, c) the patient is automatically moved to ward B, d) the patient is brought to his treatment in ward B and then transported back to ward A by the same route.

5 Claims, 4 Drawing Sheets

(56) References Cited

U.S. PATENT DOCUMENTS

| | | | | |
|---|---|---|---|---|
| 2004/0159473 | A1* | 8/2004 | Vogel | A61G 7/0513<br>180/9.1 |
| 2012/0029697 | A1 | 2/2012 | Ota et al. | |
| 2016/0070267 | A1 | 3/2016 | Hyde et al. | |

FOREIGN PATENT DOCUMENTS

| | | |
|---|---|---|
| JP | 2004222851 | 8/2004 |
| WO | 2015069186 | 5/2015 |

* cited by examiner

APPARATUS AND METHOD FOR NETWORKED TRANSPORTATION OF PATIENTS OR PEOPLE WITH IMPAIRED MOBILITY

CROSS-REFERENCE TO RELATED APPLICATIONS

This application is a § 371 national stage entry of International Application No. PCT/DE2017/000405, filed on Nov. 27, 2017, which claims priority to German Patent Application No. 10 2016 014 566.8, filed on Dec. 7, 2016 the entire contents of which are incorporated herein by reference.

The invention relates to an apparatus and a method for networked transportation of patients or people with impaired mobility.

A visitor or a patient in a hospital or in a nursing unit will quickly realize that an important problem concerns how persons requiring treatment are transported from one treatment location to another treatment location or to the respective rest location. This is generally done by a hospital bed being transported by two attendants who are called up at a certain time and who then push the respective hospital bed, with the patient on it, along various passages and floors, leave it at the target location, and then bring it back again after the treatment. This requires a very high outlay in terms of personnel and in particular takes up a great deal of time.

As regards the prior art, reference is made to the document DE 20 2013 103 255 U1. According to the details given in claim 1 of said document, the latter relates to an electrical transportation vehicle for transporting hospital beds, having: a support frame (1) which at the floor side has a pedestal (11) and is provided at both ends with a stand (12); a drive unit (2) which has at least one electric motor (21), secured to the pedestal (11), two drive wheels (22) and two rollers (23), wherein the two drive wheels (22) rotate via a motor shaft of the electric motor (21), and wherein the two drive wheels (22), together with the two rollers (23), support the entire electrical transportation vehicle;

at least one locking device (3), which is located between the two stands (12) of the support frame (1) and has a lever (31) and a clamping unit (33), wherein the clamping unit (33) has a first and a second clamping jaw (331, 332), and wherein the second clamping jaw (332) can be moved, under the effect of the lever (31), away from or toward the first clamping jaw (331); and an electronic control device (4), which is connected electrically to the electric motor (21) in order to start up the electric motor (21).

According to the details concerning the problems addressed by the invention, the transportation vehicle known from DE 20 2013 103 255 U1 serves mainly to move a hospital bed quickly and with minimal effort and to ease the workload of hospital staff.

The object of the present invention is to make available an apparatus and a method by which nursing chairs and hospital beds can be transported automatically and without the aid of human force, wherein the respective transportation operation can be controlled and monitored electronically, and technical safety arrangements and measures ensure the well-being of the person who is being transported.

This Object is Achieved by the Apparatus of Embodiment 1

An apparatus for networked transportation of patients or people with impaired mobility in a hospital bed or nursing bed, having the following features:

a) a first transportation vehicle (29) and a second transportation vehicle (30) which are configured in the same way and which each have a chassis (1) and a bridge track (3) on a raiseable and lowerable bridge platform (11), wherein a rotatable carriage (5) with a drive (4) for securing a docking crosspiece (6) is provided on the bridge track (3), b) a hospital bed with a mounting (27) with a crossmember (28) and a docking point for the docking crosspiece (6) of the first transportation vehicle (29) and a docking point for a long abutment (15) of the docking crosspiece (6) of the second transportation vehicle (30), c) an adjusting element (31) which is driven by a drive (32) and which serves to actuate front lifting rods (53) and rear lifting rods (36), wherein a lever arrangement (36, 47, 49, 51) lying between them has the effect that the center of gravity of the load lies directly in the region of the drive wheels (12), and wherein an energy supply system is present which is powered either via inductive leads routed in the ground or via movable energy supply stations, d) an electronic network with a control center for controlling a transportation operation.

Embodiment 2

The apparatus of embodiment 1, characterized in that the two transportation vehicles taking part in the transportation are regarded as one unit in terms of control technology.

Embodiment 3

The apparatus of embodiment 1, characterized in that a transportation chair is transported instead of a bed, wherein the transportation chair, for persons in rehabilitation facilities, can be provided with special additional devices suitable for the particular treatment case.

Embodiment 4

The apparatus of embodiment 1, characterized in that a camera (17) and/or a touchscreen is provided for communicative contact of the patient with the nursing staff.

Embodiment 5

The apparatus of embodiment 1, characterized in that devices for measuring the pulse and skin resistance (19) and an emergency signal transmitter with a corresponding button (20) are provided in the region of a patient.

And by the Method of Embodiment 6

A method for networked transportation of patients or people with impaired mobility in a hospital bed or nursing bed, having the following method features:

a) a patient in question or a corresponding person needing care is reported by a control center as requiring transportation from a ward A to another ward B, b) the nursing staff on ward A bed down or place the person in question in a special transportation bed or a special transportation chair and report to the control center when this person is correctly supported, this being able to be checked by means of a pressure sensor (23) in the lying surface or seating surface, the identity being ensured by the nursing staff or being able to be checked by means of a patient identity card, c) the patient is automatically driven to ward B, d) the patient is admitted for his treatment in ward B and is then transported back to ward A by the same route.

Embodiment 7

The method of embodiment 1, characterized in that a camera (17) and/or a touchscreen are provided for communicative contact of the patient with the nursing staff.

Embodiment 8

The method of embodiment 1, characterized in that devices for measuring the pulse and skin resistance (19) and an emergency signal transmitter with a corresponding button (20) are provided in the region of a patient.

Embodiment 9

A computer program with a program code for performing the method steps of embodiment 6, when the program is executed in a computer.

Embodiment 10

A machine-readable support with the program code of a computer program for performing the method of embodiment 6, when the program is executed in a computer.

The apparatus according to the invention is described in more detail below. In the figures, in detail:

FIG. 1 shows the transportation vehicle according to the invention in two sectional views.

Figure 1:
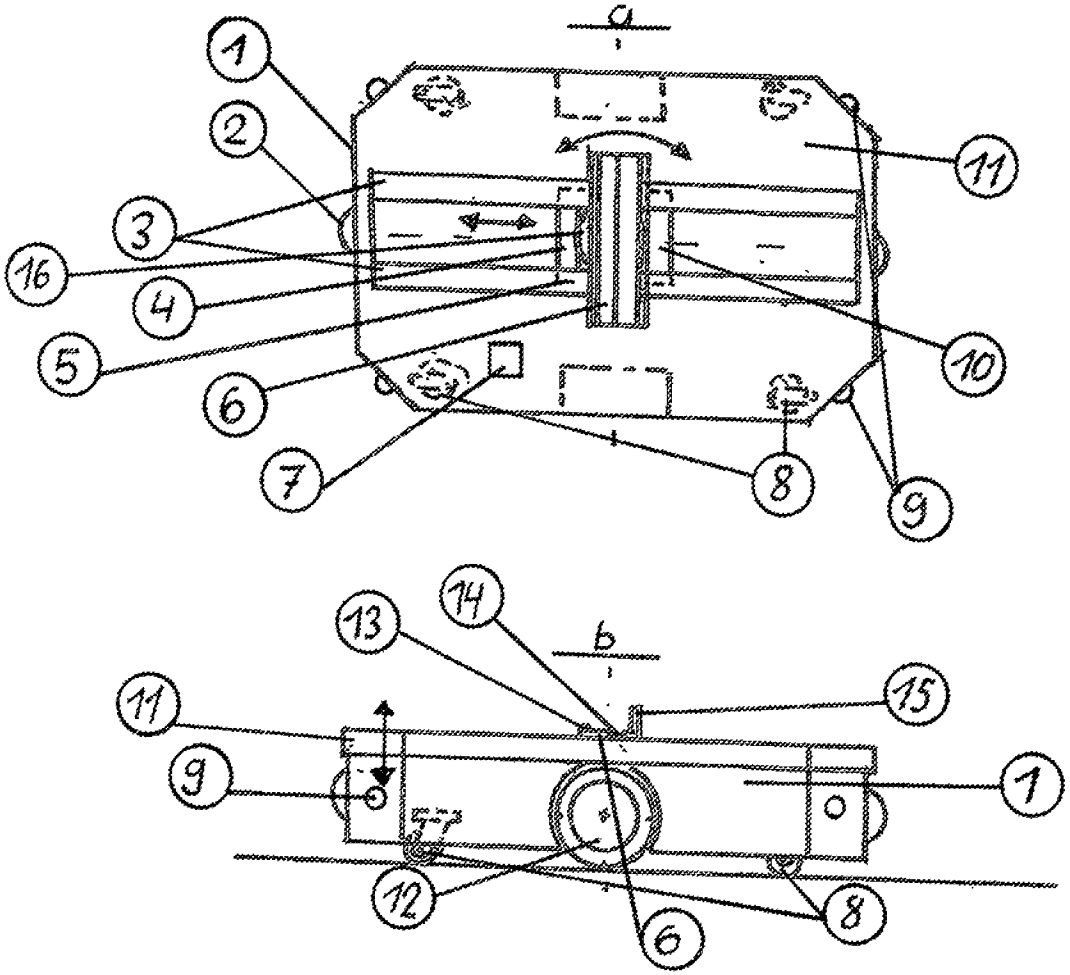
FIG. 1 shows two sectional views of the transportation vehicle according to the invention

In FIG. 1*a*), the chassis or the main body for the conveying apparatus according to the invention is designated by reference sign 1 and is viewed from above. Reference sign 2, shown at the front, designates a laser scanner of the type which, by virtue of its quality features, is approved for personal protection. The same component is located at the rear. A two-path bridge track 3, located in the middle of the chassis 1 and extending longitudinally over almost the entire length of the chassis 1, carries a carriage 5, which can be moved by means of a drive 4 over the entire length of the bridge track 3. A docking crosspiece 6 is secured on the carriage 5 and is mounted rotatably on the carriage 5 by means of a rotation mechanism 16. The drive for this is designated by 10. In FIG. 1*a*), the docking crosspiece 6 is shown transverse to the direction of travel. Reference sign 7 designates a data transmitter and a data receiver on the chassis 1, which are responsible for controlling the entire apparatus and its safety system.

Of the four articulated support rollers 8, two are indicated in FIG. 1*a*).

Moreover, the chassis 1 has a number of safety sensors and additional sensors 9 for monitoring the vehicle, which sensors also serve to minimize shadows in the scanning of obstacles.

The top face of the chassis has a lifting platform 11 for the vertical movement of the bridge track 3. With such a vertical movement of the bridge track 3, all of the devices connected to the docking crosspiece 6 are also moved vertically.

In FIG. 1*b*), the chassis 1 is shown in a side view, wherein the lifting platform 11 is indicated with its potential lifting movements. Here, a short abutment 13 and a long abutment 15 of the docking crosspiece 6 are also shown, wherein a latching recess 15 for the connection to a person-transporting chair is indicated between these abutments. In addition to the known articulated support rollers 8 and additional sensors 9, reference is also made here to one of the drive wheels 12 of the autonomous transportation vehicle.

Figure 2:
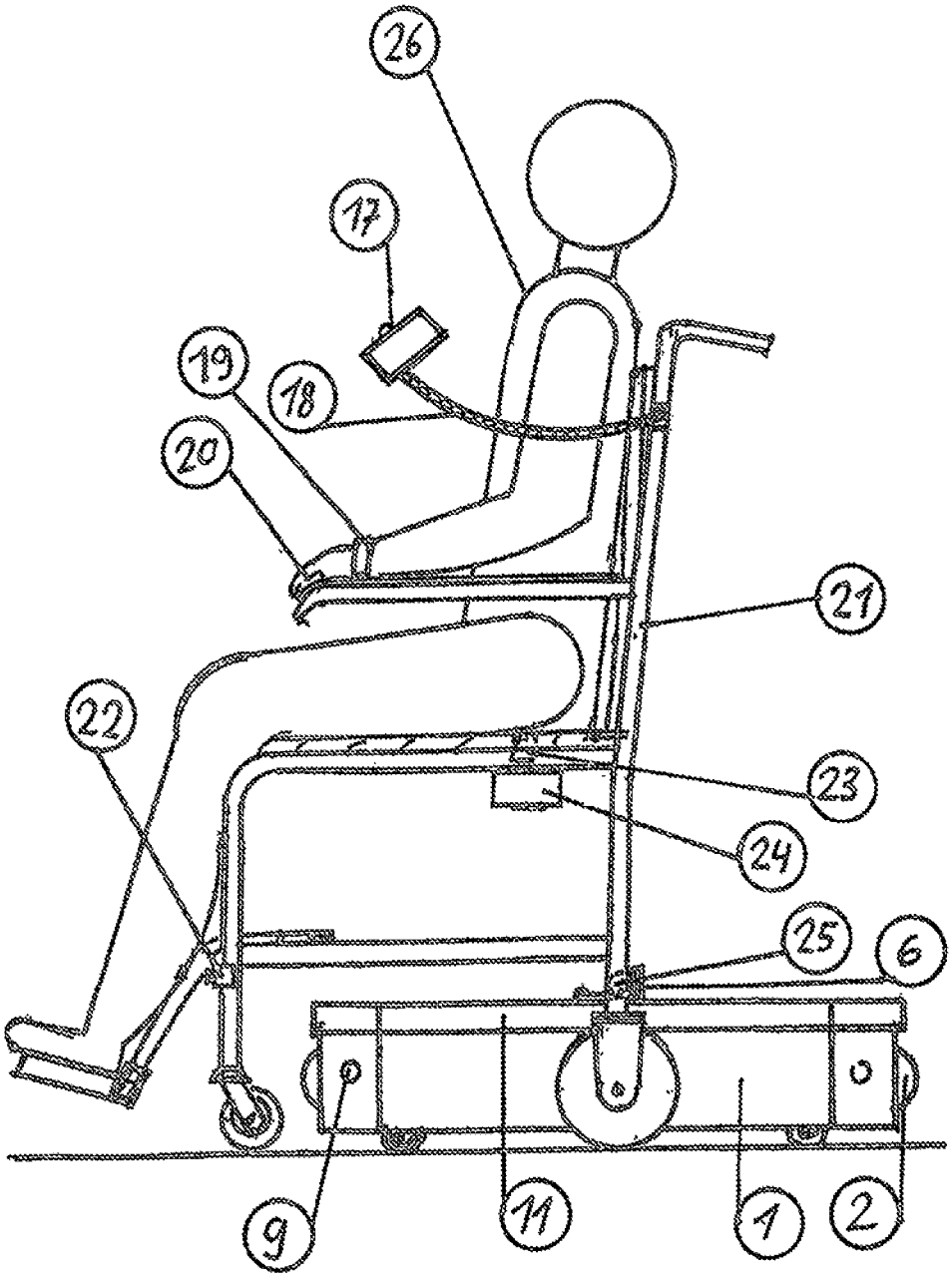
FIG. 2 shows a view of the transportation vehicle in conjunction with a transportation chair

FIG. 2 shows a view of the transportation vehicle in conjunction with a transportation chair.

In addition to a side view of the chassis 1 with a laser scanner 2 and an additional sensor 9, the docking crosspiece 6 with a cross-member 25 of a person-transporting chair 21 can also be seen on the lifting platform 11, wherein the cross-member 25 lies in a latching transportation recess 14 (not visible). At the height of the cross-member 25, the person-transporting chair 21 has safety sensors 22, although these are only shown here on the left-hand side.

To detect that the seating surface of the person-transporting chair 21 is occupied, the latter has a number of pressure sensors 23, although only one sensor is shown. Moreover, in the region of the seating surface of the person-transporting chair 21, a data transmitter and a data receiver are designated by reference sign 24 and are responsible for controlling the entire apparatus of the chair and its safety system.

To monitor how a person or patient 26 who is to be transported feels, a camera 17 for facial monitoring is used which is secured on a flexurally stiff camera adjustment mechanism 18. Instead of a camera, a touchscreen can also be installed here, which provides a patient with information, for example concerning waiting times or expected treatments. Likewise, games or news can be delivered in this way.

Pulse meters 19 and sensors for detecting the skin resistance are mounted in the region of a hand of a patient 26. Moreover, a transmitter 20, with a button for sending an emergency signal, and an emergency off switch are provided here.

In a special embodiment, provision can be made that, instead of a bed, a transportation chair is transported, in which case the latter, for persons in rehabilitation facilities, can be provided with special additional devices suitable for the respective treatment case. For example, these may be articulated supports or special measuring devices for tachycardia.

Figure 3:
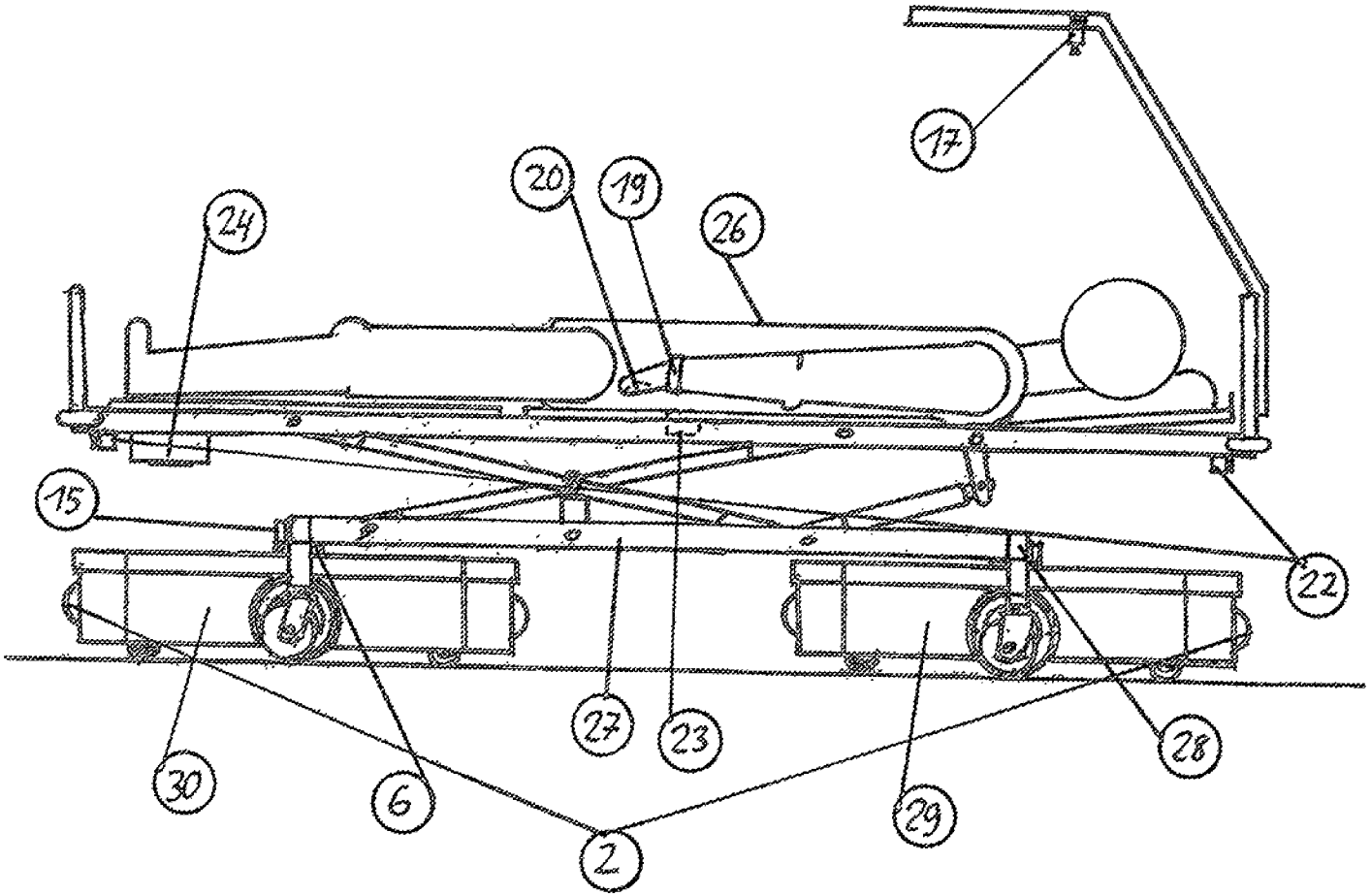
FIG. 3 shows the use of two transportation vehicles in the case of a nursing bed

FIG. 3 shows the use of two transportation vehicles in the case of a nursing bed or hospital bed.

As can be seen from FIG. 3, in order to transport a nursing bed, a first or front transportation vehicle 29 and a second or rear transportation vehicle 30 are connected by means of a nursing bed mounting 27. Here, the first transportation vehicle has a cross-member 28 which acts as docking crosspiece 6, as was shown in the description of FIG. 1 and in the second transportation vehicle. For the interconnection of the first and second transportation vehicle, the two laser scanners 2 are indicated. In the example of the second transportation vehicle, the long abutment 15 of the docking crosspiece 6 was used. To detect that the nursing bed is occupied, at least one pressure sensor 23 is used, as was also mentioned in the description of the person-transporting chair 21. Moreover, for the patient 26 who is to be transported on the nursing bed, a pulse meter 19 and sensors for detecting the skin resistance are provided, and also a transmitter 20 with a button for sending an emergency signal, and an emergency off switch. FIG. 3 also shows safety sensors 22 on the front, which ensure minimization of scanning shadow.

At the foot end of the nursing bed, a transmitting and receiving unit is mounted for the control unit and the safety system of the nursing bed. A camera 17 for facial monitoring ensures that the feelings of the patient are conveyed.

Figure 4:
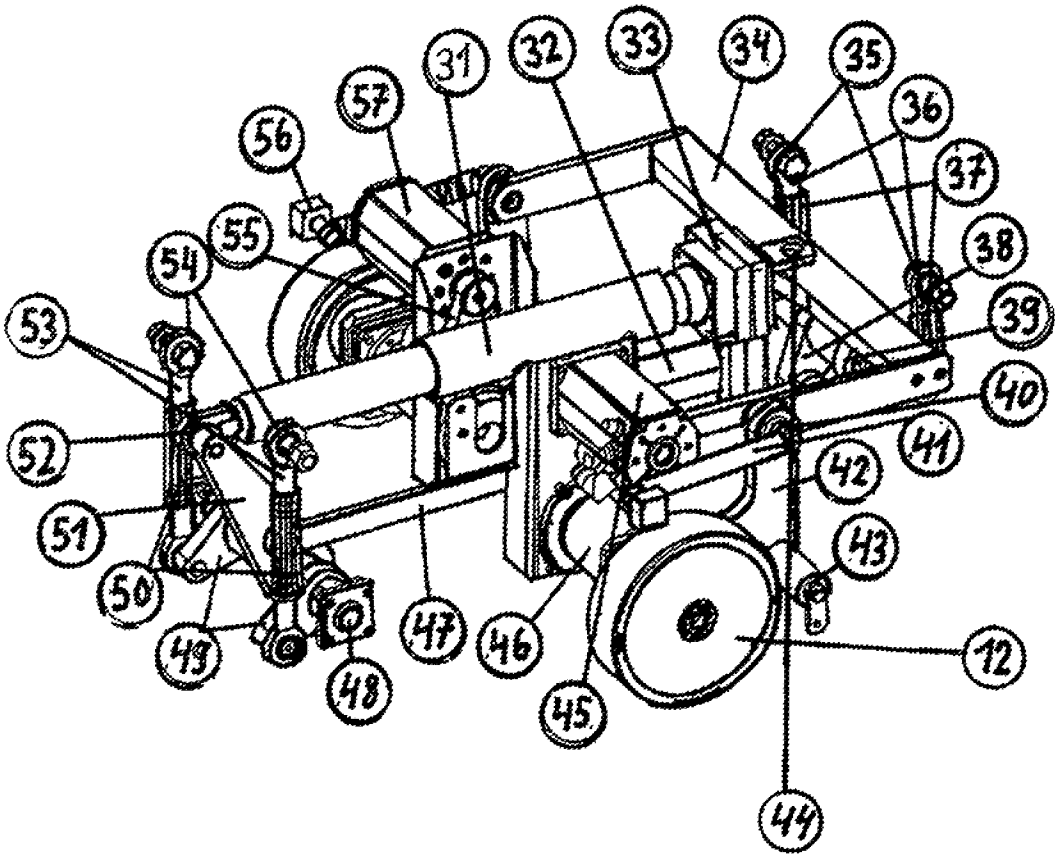
FIG. 4 shows a detailed perspective view of the kinematics of a transportation vehicle.

FIG. 4 shows a detailed perspective view of kinematics of a transportation vehicle. This figure depicts a transportation vehicle without the surrounding chassis 1. Connections to the chassis 1 will be indicated at the appropriate point. First, the kinematics of the drive wheels is explained. The left-side drive wheel 12, known from FIG. 1, and a rotation axle 43 can be seen in the foreground, wherein this rotation axle 43 is connected to the chassis 1 and is not indicated there.

The axle bearing 46 for the left-side drive wheel 12, with its servomotor 45 lying above it, is connected to a functional unit by means of an angular plate not indicated in any detail and to be seen only from the rear. In this angular plate, a gear belt runs via which the servomotor 45 drives the rotation axle of the left-side drive wheel 12. The corresponding servomotor 57 for the right-side drive can be seen on the opposite side. On this side, the corresponding angular plate can be seen from the rear, Here, the corresponding gear belt 55 running in this angular plate can be seen. The whole functional unit, composed of the drive wheel 12 with the axle bearing 46, the servomotor 45 and the angular plate with its gear belt, is pivotable about the rotation axle 43 via the angular lever 42. By way of the articulation 40, the angular lever 42 is articulated on a U-shaped transverse link 34, to the other end of which the right-side drive wheel is fastened in a corresponding manner.

Furthermore, a spring element 41 is mounted on the articulation 40, its other mounting point being fastened to the housing. On the left side of the transportation vehicle visible in FIG. 4, this articulation point or bearing point is shown as a block-shaped mounting, which is barely visible. By contrast, on the opposite side, this point is designated as an articulation point 56 of the right-hand spring element. The spring element 41 serves the purpose of pushing the drive wheel 12 onto the floor surface by way of the angular lever 34 and thus to improve contact of the drive wheel 12 with the floor.

This applies in a corresponding manner to the right-hand drive wheel lying opposite.

A further kinematics set-up is explained below for lifting the bridge platform 11, or the person-transporting chair 21 placed thereon, or a part of a patient bed as the load.

In order to be able to receive a load, it is necessary for the transportation vehicle to lift the load after being driven therebelow and to release its floor contact so as to be able to transport the load.

The front lifting rods 53 and the rear lifting rods 36 by way of direct contact serve this purpose.

The lifting rods 53 and 36 are raised and lowered by means of an adjusting element 31 which, by means of a threaded spindle, generates the required forces by way of a retractable and deployable cylinder by way of a swivel head 52 and an articulated lift-and-rotate lever 51.

It can clearly be seen from the left-hand side in FIG. 4 how the lift-and-rotate lever 51, in interaction with in each case one front lifting-rod lever 49, causes the necessary positional changes of the two front lifting rods 53 by means of corresponding rotation movements about a rotation axle 48.

The front lifting rods 53 each carry the corresponding front support plate suspension 54.

At the same time, it can be seen from this region of FIG. 4 that a push rod 47 is articulated on the lift-and-rotate lever 51, which push rod 47 transmits the movements of the lift-and-rotate lever 51 to in each case one rear push-rod lever 39 via an axle lever 38. The movements of the rear push-rod lever 39 lead to the necessary positional changes of the two rear lifting rods 36.

The rear lifting rods 36 in each case support the corresponding rear support plate suspension 35.

The movement of the adjusting element 31 takes place via a drive 32 and a power transmission 33 which diverts force. The power transmission 33 is fastened to the transverse link 34 by means of a fork head 44. Since the fork head 44 is rotatably mounted on the transverse link 34, the transverse link 34, as connection element between the two angular levers 42, can move, thus enabling the two drive wheels to execute mutually independent vertical pivoting movements.

The adjusting elements 50 for the front lifting rods 53 and the adjusting elements 37 for the rear lifting rods 36 are indicated in FIG. 4 as darkened regions of the corresponding lifting rods.

Overall, on account of the demonstrated arrangement of the lifting rods 36 and 53, the lever arrangement 38, 47, 49, 51 lying therebetween, and the adjusting element 37 in interaction with the transverse link 34, and the action thereof on the angular lever 42, it is ensured that the center of gravity of the load lies directly in the region of the drive wheels.

Therefore, the support wheels 8 have substantially a stabilizing function.

An energy supply system is present which ensures the charging of batteries either via inductive leads routed in the floor or via movable energy supply stations.

The hospital beds according to the invention are either stored in special storage rooms with their transportation vehicles or are stored on special bearings which in terms of the height of their underside permit engagement and lifting by means of the transportation vehicles.

The hospital beds or person-transporting chairs equipped with the respective transportation vehicles are controlled via a control center which is located in the respective hospital or healthcare center and which permits radio contact, at a special radio frequency, with all vehicles in all of the corridors and elevators.

A hospital bed is controlled by means of a special control system that considers the two vehicles participating in the transportation operation as one unit.

If the control center in question decides that a patient is to be conveyed from ward A to ward B, the vehicle automatically travels the prescribed route with the patient in the relevant bed. The nursing personnel in this case then decide whether the patient is able to be transported and notify the control center of the state ready for transportation. Depending on the state of development of the overall transportation system, the transportation then takes place either directly from the hospital room or from a special standby area of the respective hospital ward.

LIST OF REFERENCE SIGNS

1 chassis
2 laser scanner
3 bridge track for the carriage 5
4 drive for the carriage 5

5 carriage (on the bridge track) with rotation mechanism 16 for a docking crosspiece 6
6 docking crosspiece for person-transporting chair or nursing bed
7 data receiver for the control unit and a safety system
8 articulated support roller
9 safety sensors and additional sensors for monitoring the driving space
10 drive for rotation mechanism of the docking crosspiece 6 (cf. carriage 5)
11 bridge platform for the vertical movement of the bridge track 3
12 drive wheels of an autonomous transportation vehicle
13 short abutment of the docking crosspiece 6
14 latching transportation recess for transport of a transportation chair
15 long abutment of the docking crosspiece 6
16 rotation mechanism for the docking crosspiece 6
17 camera for facial monitoring, touchscreen
18 flexurally stiff adjustment mechanism for the camera 17 with a chair attachment
19 pulse meter and sensors for detecting the skin resistance
20 transmitter with a button for sending an emergency signal and an emergency off switch
21 person-transporting chair
22 safety sensors, scan shadow minimization
23 pressure sensors in the seating surface
24 transmitting and receiving unit for the control unit and the safety system of the person-transporting chair 21
25 cross-member of the person-transporting chair 21 and docking point for the transportation recess 14
26 patient or transported person
27 mounting for a nursing bed or hospital bed
28 cross-members of the mounting 27 of a nursing bed and docking point for a docking crosspiece 6
29 front or first transportation vehicle
30 rear or second transportation vehicle
31 adjusting element, threaded spindle
32 drive for the adjusting element 31
33 power transmission from the drive 32 to the adjusting element 31
34 transverse link
35 rear lifting rod
36 rear lifting rod
37 adjusting element for a rear lifting rod
38 axle lever
39 rear lifting-rod lever
40 articulation for an angular lever 40
41 spring element
42 angular lever
43 rotation axle
44 fork head
45 servomotor for left-side drive wheel
46 axle bearing for the left-side drive wheel
47 push rod
48 rotation axle for a front lifting-rod lever
49 front lifting-rod lever
50 adjusting element for a front lifting rod
51 lift-and-rotate lever
52 swivel head
53 front lifting rod
54 front support plate suspension
55 gear belt for the right-side drive
56 articulation point of right-hand spring element on the housing 3
57 servomotor for the right-side drive

The invention claimed is:

1. An apparatus for networked transportation of patients or people with impaired mobility in a hospital bed or nursing bed, having the following features:

a) a first transportation vehicle (29) and a second transportation vehicle (30) which are configured in the same way and which each have a chassis (1) and a bridge track (3) on a raiseable and lowerable bridge platform (11), wherein a rotatable carriage (5) with a drive (4) for securing a docking crosspiece (6) is provided on the bridge track (3), b) a hospital bed having a mounting (27) with a cross-member (28) and a docking point for the docking crosspiece (6) of the first transportation vehicle (29) and a docking point for a long abutment (15) of the docking crosspiece (6) of the second transportation vehicle (30), c) an adjusting element (31) which is driven by a drive (32) and which serves to actuate front lifting rods (53) and rear lifting rods (36), wherein a lever arrangement (36, 47, 49, 51) lying between said lifting rods has the effect that the center of gravity of the load lies directly in the region of the drive wheels (12), and wherein an energy supply system is present which is powered either via inductive leads routed in the ground or via movable energy supply stations, d) an electronic network with a control center for controlling a transportation operation.

2. The apparatus as claimed in claim 1,
characterized in that
the two transportation vehicles taking part in the transportation are regarded as one unit in terms of control technology.

3. The apparatus as claimed in claim 1,
characterized in that
a transportation chair is transported instead of a bed, wherein the transportation chair, for persons in rehabilitation facilities, can be provided with special additional devices that are suitable for the particular treatment case.

4. The apparatus as claimed in claim 1,
characterized in that
a camera (17) and/or a touchscreen is provided for communicative contact of the patient with the nursing staff.

5. The apparatus as claimed in claim 1,
characterized in that
devices for measuring the pulse and skin resistance (19) and an emergency signal transmitter with a corresponding button (20) are provided in the region of a patient.

* * * * *